US005116707A

United States Patent [19]

Kanzaki et al.

[11] Patent Number: 5,116,707

[45] Date of Patent: May 26, 1992

[54] LAMINATED ORGANIC PHOTOSENSITIVE MATERIAL

[75] Inventors: Toshiaki Kanzaki; Yosuke Matsui, both of Kobe, Japan

[73] Assignee: Bando Chemical Industries, Ltd., Kobe, Japan

[21] Appl. No.: 558,339

[22] Filed: Jul. 27, 1990

[30] Foreign Application Priority Data

Jul. 28, 1989 [JP] Japan ..... 1-197424

[51] Int. Cl.[5] ..... G03G 5/047

[52] U.S. Cl. ..... 430/59

[58] Field of Search ..... 430/59

[56] References Cited

U.S. PATENT DOCUMENTS 4,751,163 6/1988 Hagiwara et al. ..... 430/59

FOREIGN PATENT DOCUMENTS 210938 9/1988 Japan ..... 430/59
142727 6/1989 Japan ..... 430/59
144057 6/1989 Japan ..... 430/59
135355 5/1990 Japan ..... 430/59

*Primary Examiner*—Roland Martin

*Attorney, Agent, or Firm*—Wegner, Cantor, Mueller & Player

[57] ABSTRACT

A laminated organic photosensitive material which comprises an electroconductive support, a charge producing formed thereon, wherein the charge transporting layer layer and a charge transporting layer contains a mixture of a bistyryl compound represented by the formula in an amount of 65-90% by weight based on the mixture as a first charge transporting substances and a further compound in an amount of 35-10% by weight based on the mixture as a second charge transporting substance, and the mixture has a glass transition temperature of not more than 45° C.

7 Claims, 2 Drawing Sheets

LAMINATED ORGANIC PHOTOSENSITIVE MATERIAL

BACKGROUND OF THE INVENTION

1. Field of the Invention

This invention relates to a durable laminated organic photosentive material which has a charge producing layer and a charge transporting layer formed on an electroconductive support.

2. Description of the Prior Art

A composite or laminated type organic photosensitive material has been developed and put to practical use in recent years. This type of organic photosensitive material is disclosed in, for example, Japanese Patent Publications Nos. 42380/1980 and 34099/1985. It comprises an electroconductive support, a charge producing layer formed on the support and a charge transporting layer formed on the charge producing layer. For instance, such a composite photosensitive material has an electroconductive support of aluminum layer, a charge producing layer formed on the aluminum layer, and a charge transporting layer formed on the charge producing layer.

The charge transporting layer is formed by, for example, preparing a dispersion of a charge transporting substance together with an organic solvent, a binder resin and, if necessary a plasticizer, applying the dispersion onto the support, and drying to a thin film. The charge producing layer is formed by, for example, dissolving a charge producing substance in an organic solvent together with a binder resin and, if required, a plasticizer, applying the solution onto the charge transporting layer, and drying to a thin film.

There are already known a variety of charge producing substances including phthalocyanine compounds, as disclosed in Japanese Patent Laid-Open No. 166959/1984. A number of charge transporting substances are slso already known, and among which is a bistyryl compound represented by the formula

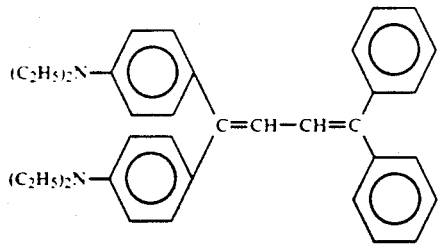

as disclosed in Japanese Patent Laid-open No. 30255/1987.

The laminated organic photosentive material which contains the above mentioned bistyryl compound as a charge transporting substance has an advantage that it is readily charged, however, there is an undesirable tendency that cracks are generated on the surface of the charge transporting layer which contains the bistyryl compound when the laminated organic photosentive material is used over a long period of time. Namely, the photosentive material does not stand long term use and hence is non-durable.

SUMMARY OF THE INVENTION

It is, therefore, an object of the invention to solve the problems as above set forth involved in the known laminated organic photosensitive material, and to provide a laminated organic photosensitive material which contains the bistyryl compound as a charge transporting substance and which nevertheless stands long term use free from generation of cracks on the surface of the charge transporting layer.

In accordance with the invention, there is provided a laminated organic photosentive material which comprises an electroconductive support, a charge producing layer and a charge transporting layer formed thereon, wherein the charge transporting layer contains a mixture of a bistyryl compound represented by the formula

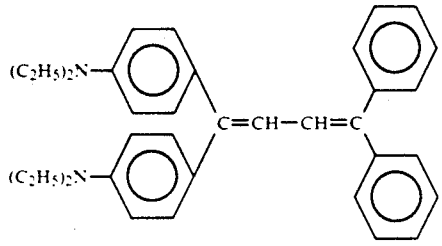

in an amount of 65-90% by weight based on the mixture as a first charge transporting substance and a further compound in an amount of 35-10% by weight based on the mixture as a second charge transporting substance, and the mixture has a glass transition temperature of not more than 45° C.

DETAILED DESCRIPTION OF THE INVENTION

Figure 1:
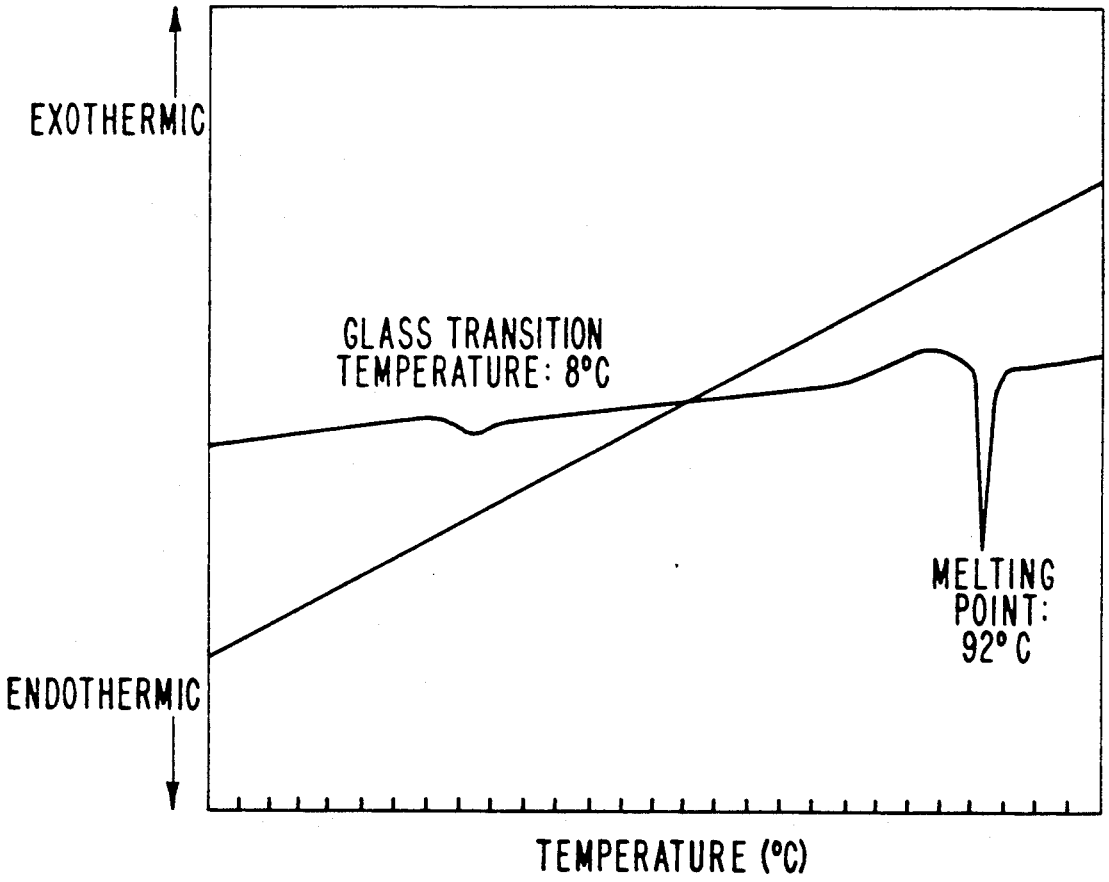
FIG. 1 is a differential scanning calorimeter (DSC) diagram of the compound (1) used as a second charge transporting substance in the invention.

The laminated organic photosensitive material of the invention has a charge producing layer on an electroconductive support. The charge producing layer contains a charge producing substance, and there may be used any known charge producing substance. It includes, for example, X-type nonmetal phthalocyanine as described in U.S. Pat. No. 3,816,118, metal phthalocyanine pigments and azo pigments.

The binder resin for the charge producing layer is not specifically limited, and it may be either a thermoplastic or thermosetting resin. The binder resin may be exemplified by, for example, polystyrene, styrene-acrylonitrile copolymer, styrene-butadiene copolymer, styrene-maleic anhydride copolymer, polyester resin, polyvinyl chloride, ethylene-vinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin.

The smaller the content of the binder resin in the charge producing layer, the better, but it is usually in the range of about 5-50% by weight based on the layer. The charge producing layer has a thickness usually of about 0.05-1 microns. The organic solvent used in the preparation of the charge producing layer is such that it dissolves the binder resin. Thus, the organic solvent used includes, for example, benzene, toluene, xylene, methylene chloride, chloroform, 1,2-dichloroethane, 1,1,2,2-tetrachloroethane, chlorobenzene, dichlorobenzene, ethyl acetate, butyl acetate, methyl ethyl ketone, dioxane, tetrahydrofuran, cyclohexanone, methyl cellosolve or ethyl cellosolve.

The laminated organic photosensitive material of the invention has a charge transporting layer on the charge producing layer. The charge transporting layer contains a mixture of the aforesaid bistyryl compound in an amount of 65-90%, preferably of 70-80% by weight, based on the mixture as a first charge transporting substance and a further compound in an amount of 35-10%, preferably of 30-20% by weight, based on the mixture as a second charge transporting substance which acts also as a plasticizer.

The use of the second charge transporting substance in an amount of more than 35% by weight based on the mixture adversely affects the charge transporting layer. However, the use of the second charge transporting substance in an amount of less than 10% by weight based on the mixture fails to provide desirable plasticity with the charge transporting layer, as hereinafter explained.

It is further necessary that the mixture has a glass transition temperature of not more than 45° C.

There may be exemplified as such a second charge transporting substance, for example:

a compound (1) represented by

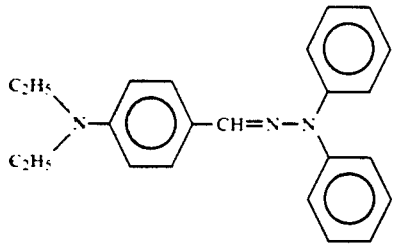

and having a glass transition temperature of 8° C.;

a compound (2) represented by

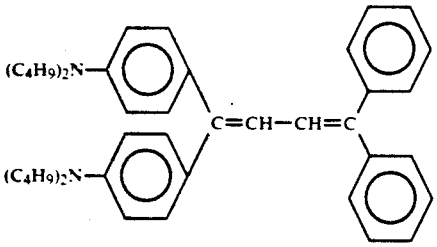

and having a glass transition temperature of 5° C.;

a compound (3) represented by

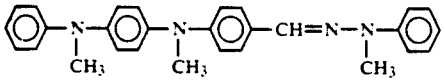

and having a glass transition temperature of 13° C.; or a compound (4) represented by

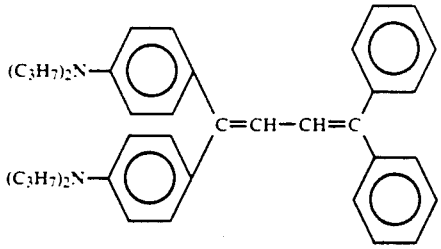

and having a glass transition temperature of 11° C.

The above compounds (1) to (4) are all low molecular weight organic compounds like the first charge transporting substance, but they all have a glass transition temperature of not more 20° C., as confirmed by DSC analysis.

Thus, it is preferred that the mixture having a glass transition temperature of not more 45° C. is prepared by admixing the first charge transporting substance with a second charge transporting substance having a glass transition temperature of not more 20° C. each within the range of amounts as hereinbefore mentioned.

It is not necessarily needed in the invention that the second charge transporting substance is excellent in charging properties since the first charge transporting substance has excellent charging properties. Thus, it should be understood that a variety of such known charge transporting substances as cause no deterioration of the properties of the charge transporting layer may be used as a second charge transporting substance other than the hereinbefore exemplified second charge transporting substances. However, the amount is limited as set forth hereinbefore so that the charge transporting layer is readily charged.

The second charge transporting substance has a low glass transition temperature, and thus it functions as a plasticizer as well as a charge transporting substance in a charge transporting layer so that the charge transporting layer which contains the mixture of the first and second charge transporting substances has a low glass transition temperature as low as not more than 45° C. Thus, when a solution of a mixture of the first and second charge transporting substances and a binder resin is coated onto the charge producing layer, heated and dried to evaporate the solvent, the resultant layer bears internal residual stress generated in the layer. As a result, there is obtained a charge transporting layer free from the generation of cracks over long term use of laminated photosensitive material. Further, such a charge transporting layer is highly wear resistant.

The binder resin for the charge transporting layer is of the type which is soluble in an organic solvent and is highly compatible with the charge transporting substance so that a stable solution thereof may be prepared easily. Moreover, it is preferable to use a resin which is inexpensive and can form a film of high mechanical strength, transparency and electrical insulation. Preferred examples of the binder resin may be exemplified by, for example, polystyrene, styrene-acrylonitrile copolymer, styrenebutadiene copolymer, styrene-maleic anhydride copolymer, polyester resin, polyvinyl chloride, ethtylene-vinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin.

The organic solvent used for the preparation of the charge transporting layer may include, for example, tetrahydrofuran, dioxane, toluene, chlorobenzene, methylene chloride, chloroform, 1,2-dichloroethane or 1,1,2,2-tetrachloroethane.

The content of the charge transporting substance in the charge transporting layer is usually in the range of about 10-60% by weight based on the layer, and the thickness of the layer is usually in the range of about 5-10 microns.

The invention will now be described more specifically with reference to examples, however, the invention is not limited thereto.

In the examples, the prepared laminated organic photosensitive materials were each fitted to a laser beam printer (Model F1000— available from Kyocera K.K.) and 10000 sheets of copies were made to evaluate the copying performance (copying test). After the copying test, the photosensitive material was taken out of the printer and the wear of surface of the charge transporting layer was measured.

For a further evaluation of properties of the photosensitive materials, they were immersed in n-butanol at room temperature to accelerate the generation of cracks on the surface of charge transporting layer (immersing test).

EXAMPLE 1

An amount of 0.3 g of X-type nonmetal phthalocyanine (8120B from Dainippon Ink Kagaku Kogyo K.K.) was added to a solution of 0.2 g of ethylene/vinyl acetate/vinyl chloride copolymer (Graftmer R-5 from Nippon Zeon K.K.) in 15 ml of tetrahydrofuran, and then the resultant mixture was milled in a ball mill for two hours. An additional amount of 7.5 ml of tetrahydrofuran was added to the mixture to prepare a dispersion.

The dispersion was applied onto an aluminum drum substrate of 262 mm in breadth and 30 mm in diameter and then dried by heating to form a charge producing layer having a thickness of 0.5 microns.

An amount of 7.5 g of the hereinbefore mentioned bistyryl compound as the first charge transporting substance and 2.5 g of the compound (1) as the second charge transporting substance were dissolved in a solution of 12 g of polycarbonate resin (Yupiron E-2000 from Mitsubishi Gas Kagaku Kogyo K.K.) in 75 ml of chloroform.

The resultant solution was applied onto the charge producing layer, and then dried by heating at 100° C. for one hour to form a charge transporting layer having thickness of 20 microns, whereby a laminated organic photosensitive material was obtained.

The mixture of the first and the second charge transporting substances was found to have a glass transition temperature of 45° C.

FIG. 1 is a DSC diagram of the compound (1).

After the copying test, no deterioration in copying performance was observed while the wear of the charge transporting layer was found 9.5 to be microns in thickness. Very slight cracks were found on the surface of the charge transporting layer after immersing the photosensitive material in n-butanol over a period of 20 hours.

EXAMPLE 2

A laminated organic photosentive material was prepared using 7.0 g of the aforesaid bistyryl compound as the first charge transporting substance and 3.0 g of the aforesaid compound (1) as the second charge transporting substance in the same manner as in the Example 1. The mixture of the first and second charge transporting substances was found to have a glass transition temperature of 41° C.

After the copying test, no deterioration in copying performance was observed while the wear of the charge transporting layer was found 6.5 to be microns in thickness. No cracks were found on the surface of the charge transporting layer after immersing test over a period of more than one month.

EXAMPLE 3

A laminated organic photosentive material was prepared using 7.0 g of the aforesaid bistyryl compound as the first charge transporting substance and 3.0 g of the aforesaid compound (2) as the second charge transporting substance in the same manner as in the Example 1. The mixture of the first and second charge transporting substances was found to have a glass transition temperature of 39° C.

After the copying test, no deterioration in copying performance was observed while the wear of the charge transporting layer was found 6.3 to be microns in thickness. No cracks were found on the surface of the charge transporting layer after immersing test over a period of more than one month.

EXAMPLE 4

A laminated organic photosentive material was prepared using 7.0 g of the aforesaid bistyryl compound as the first charge transporting substance and 3.0 g of the aforesaid compound (3) as the second charge transporting substance in the same manner as in the Example 1. The mixture of the first and second charge transporting substances was found to have a glass transition temperature of 44° C.

Figure 2:
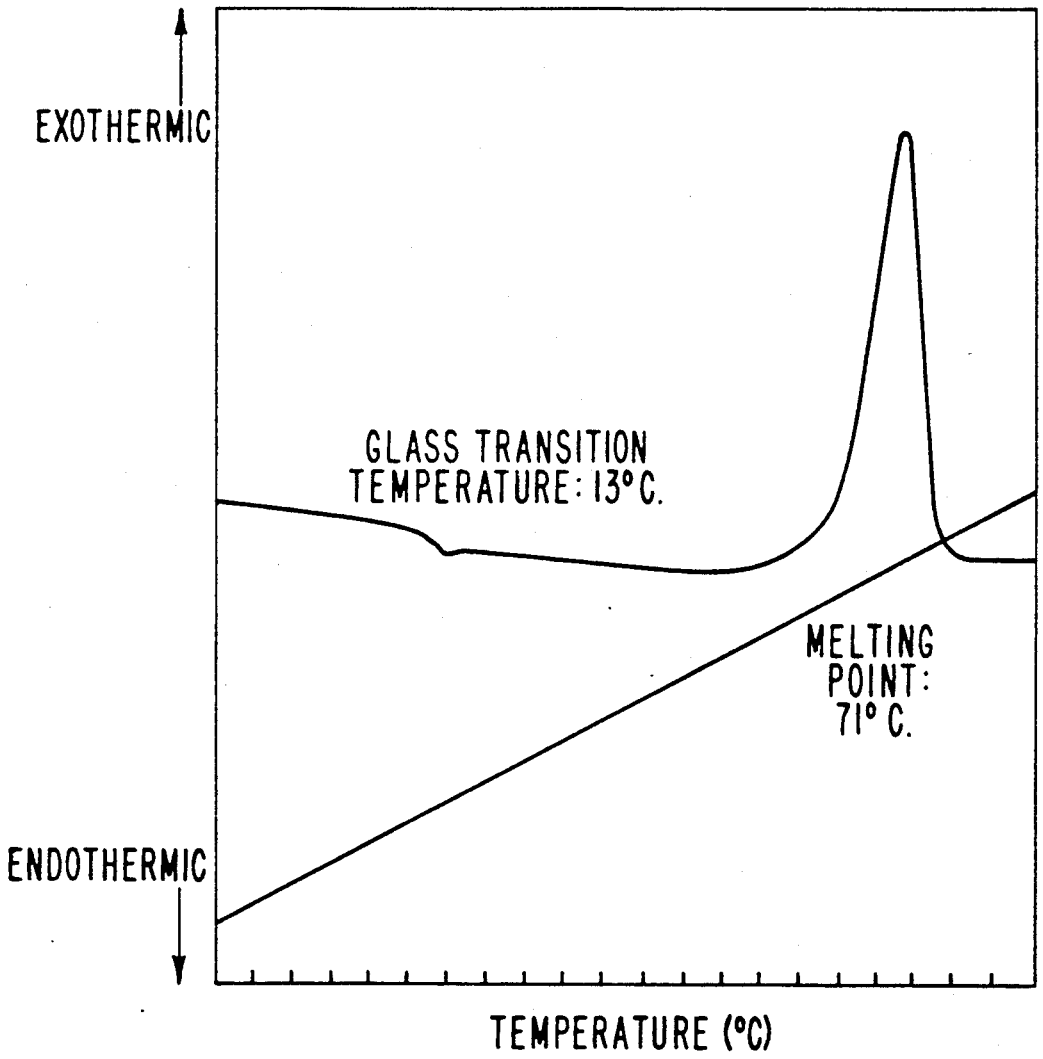
FIG. 2 is a DSC diagram of the compound (3) also used as a second charge transporting substance in the invention.

FIG. 2 is a DSC diagram of the compound (3).

After the copying test, no deterioration in copying performance was observed while the wear of the charge transporting layer was found 6.6 to be microns in thickness. No cracks were found on the surface of the charge transporting porting layer after immersing test over a period of more than one month.

COMPARATIVE EXAMPLE 1

A laminated organic photosentive material was prepared using 10.0 g of the aforesaid bistyryl compound only as a charge transporting substance in the same manner as in the Example 1.

When 4500 sheets of copies were made, there appeared defects on copied images. The photosentive material was found to have cracks in part on the surface of the charge transporting layer. The wear of the charge transporting layer was found to be 5.0 microns after copying of 4500 sheets.

Cracks were generated on the whole surfaces of the charge transporting layer when it was immersed in n-butanol over 15 minutes.

COMPARATIVE EXAMPLE 2

A laminated organic photosentive material was prepared using 6.0 g of the aforesaid bistyryl compound as the first charge transporting substance and 4.0 g of the aforesaid compound (1) as the second charge transporting substance in the same manner as in the Example 1. The mixture of the first and second charge transporting substances was found to have a glass transition temperature of 38° C.

When 1000 sheets of copies were made, the image density decreased and fog appeared on the copied images. The wear of the charge transporting layer was found 6.3 to be microns after copying of 10000 sheets. However, no cracks were found on the surface of the charge transporting layer after immersing test over a period of more than one month.

COMPARATIVE EXAMPLE 3

A laminated organic photosentive material was prepared using 7.0 g of the aforesaid bistyryl compound as the first charge transporting substance and 3.0 g of the compound (5) as the second charge transporting substance which is represented by the formula

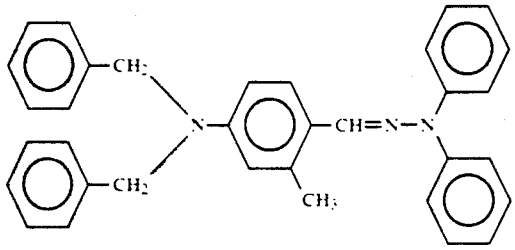

and having a glass trasition temperature of 31° C. in the same manner as in the Example 1. The mixture of the first and second charge transporting substance was found to have a glass transition temperature of 68° C.

After the copying test, no deterioration in copying performance was observed while the wear of the charge transporting layer was found to be 8.4 microns in thickness. However, cracks were generated on the whole surfaces of the charge transporting layer when it was immersed in n-butanol over 20 minutes.

COMPARATIVE EXAMPLE 4

A laminated organic photosentive material was prepared using 0.5 g of the aforesaid bistyryl compound as the first charge transporting substance and 9.5 g of the aforesaid compound (4) as the second charge transporting substance in the same manner as in the Example 1. The mixture of the first and second charge transporting substance was found to have a glass transition temperature of 25° C.

When 3000 sheets of copies were made, the image density decreased and fog appeared on the copied images. The wear of the charge transporting layer was found to be 7.6 microns after copying of 10000 sheets. Cracks were generated on the whole surfaces of the charge transporting layer when it was immersed in n-butanol over for one hour.

COMPARATIVE EXAMPLE 5

A laminated organic photosentive material was prepared using 7.0 g of the aforesaid bistyryl compound and 3.0 g of octyl phthalate as a plasticizer in the same manner as in the Example 1.

The image density decreased at the initial stage of copying test and fog appeared on the copied images. The wear of the charge transporting layer was found to be 7.0 microns after copying of 10000 sheets. However, no cracks were found on the surface of the charge transporting layer after immersing test over a period of more than one month.

What is claimed is:

1. A laminated organic photosensitive material which comprises an electroconductive support, a charge producing layer and a charge transporting layer on the charge producing layer, wherein the charge transporting layer comprises a mixture of a bistyryl compound represented by the formula

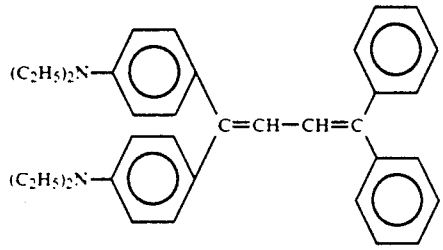

in an amount of 65-90% by weight based on the mixture as a first charge transporting substance and a second charge transporting substance which is at least one compound selected from the group consisting of

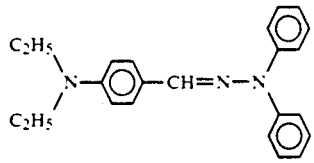

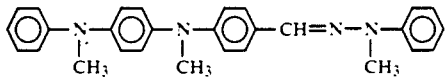

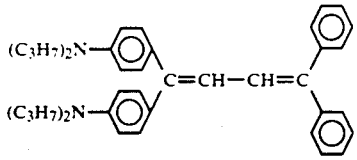

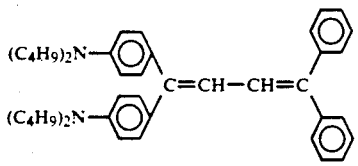

in an amount of 35-10% by weight based on the mixture, the second charge transporting substance having a glass transition temperature of not more than 20° C., the mixture having a glass transition temperature of not more than 45° C.

2. A laminated organic photosensitive material of claim 1, wherein the first charge transporting substance is present in an amount of 70-80% by weight based on the mixture and the second charge transporting substance is present in an amount of 30-20% by weight based on the mixture.

3. A laminated organic photosensitive material of claim 1, wherein the charge producing layer comprises a charge producing substance and a binder resin.

4. The laminated organic photosensitive material as claimed in claim 1 wherein the second charge transporting substance is

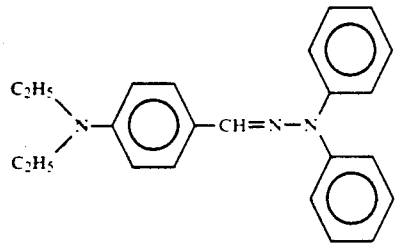

5. The laminated organic photosensitive material as claimed in claim 1 wherein the second charge transporting substance is

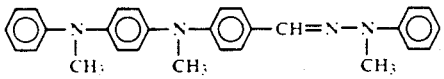

6. The laminated organic photosensitive material as claimed in claim 1 wherein the second charge transporting substance is

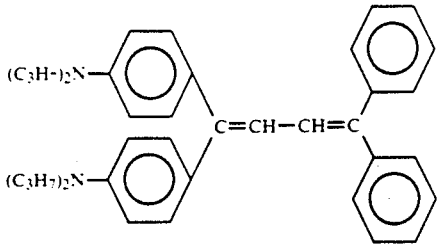

7. The laminated organic photosensitive material as claimed in claim 1 wherein the second charge transporting substance is

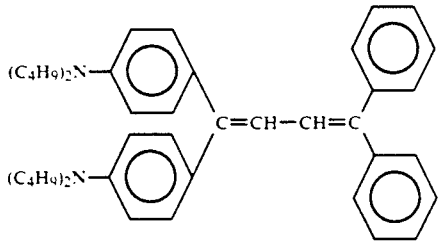

* * * * *